United States Patent [19]

Dunigan et al.

[11] 3,994,946

[45] Nov. 30, 1976

[54] NOVEL BALLISTIC MODIFIER RESISTANT TO HYDROLYSIS

[75] Inventors: Thomas E. Dunigan, Oak Ridge; George C. Sisco, Budd Lake; Lawrence W. Pell, West Orange, all of N.J.

[73] Assignee: The United States of America as represented by the Secretary of the Army, Washington, D.C.

[22] Filed: Jan. 3, 1973

[21] Appl. No.: 317,701

Related U.S. Application Data

[62] Division of Ser. No. 141,365, May 7, 1971.

[52] U.S. Cl. ..... 260/435 R; 260/438.1; 149/98

[51] Int. Cl. ..... C07F 7/24

[58] Field of Search ..... 260/435 R, 438.1; 149/98

[56] References Cited

UNITED STATES PATENTS

| | | | |
|---|---|---|---|
| 3,138,499 | 6/1964 | Camp et al. | 149/98 X |
| 3,228,338 | 1/1966 | McEwan et al. | 149/39 |

*Primary Examiner*—Stephen J. Lechert, Jr.
*Attorney, Agent, or Firm*—Nathan Edelberg; A. Victor Erkkila

[57] ABSTRACT

A novel ballistic modifier complex is produced by mixing and interacting an organic isocyanate with lead beta resorcylate and cupric salicylate in an inert solvent. The complex product obtained after removal of the solvent, when incorporated into a nitrocellulose-nitroglycerine double base propellant, yields a propellant composition of excellent ballistic properties and improved stability against development of exudate which inhibits ignition.

6 Claims, 1 Drawing Figure

HIGH PRESSURE STRAND BURNING RATE DATA

NOVEL BALLISTIC MODIFIER RESISTANT TO HYDROLYSIS

Figure 1:
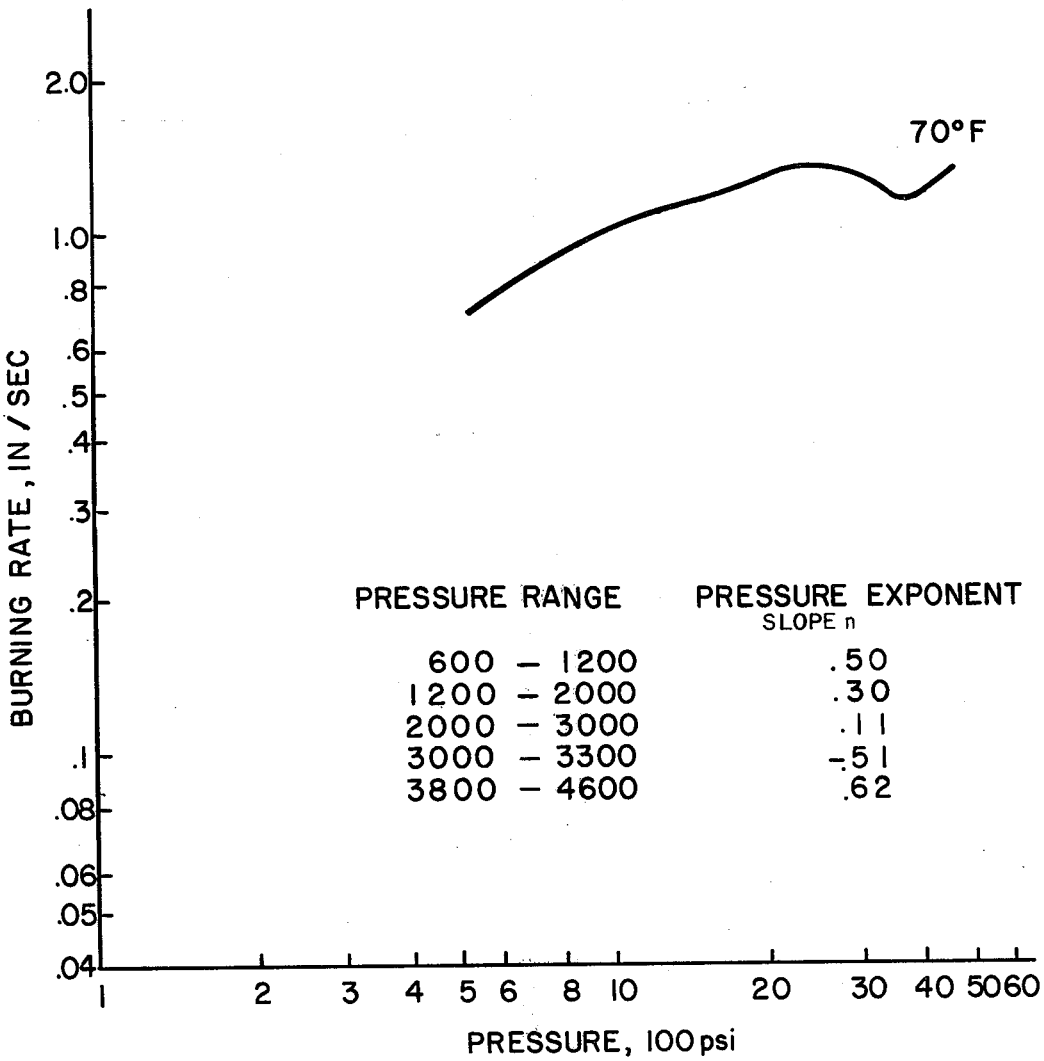

The invention described herein may be manufactured, used and licensed by or for the Government for governmental purposes without the payment to us of any royalty thereon.

This is a division of application Ser. No. 141,365, filed May 7, 1971.

BACKGROUND OF THE INVENTION

This invention relates to improvements in double base propellants containing nitrocellulose and nitroglycerine. More particularly, it relates to novel double base propellants of this type possessing improved stability and mesa or plateau type burning characteristics.

As is well known, the burning rate of a propellant at a given initial temperature is mathematically expressed by the equation $r = cp^n$, where $r$ is the burning rate, $p$ is the pressure and $c$ and $n$ are constants characteristic of the particular propellant composition. This relationship can be expressed as $\log r = n \log p + \log c$.

For a conventional propellant a plot of $\log r$ against $\log p$ produces a straight line having a slope $n$, i.e. the burning rate increases exponentially with increasing pressure. Hence, conventional propellants are not well suited as rocket propellants due to their rapid pressure buildup and dependency of burning rate on initial propellant temperature.

Plateau type propellants, wherein the pressure exponent $n$ is zero in a particular pressure region, partially overcome the aforesaid disadvantages in that at a given ignition temperature they provide a steady burning rate — and hence steady thrust — within the region; but their performance is still quite dependent on propellant temperature.

In mesa type propellants the pressure exponent $n$ is negative over a pressure range, so that the burning rate decreases slightly with increasing pressure. Also, unlike conventional and plateau type propellants, mesa propellants are substantially insensitive to temperature over wide ranges of pressure, including the mesa region. Mesa type propellants are thus eminently suited for use in rocket motors, since by virtue of their characteristic of temperature insensitivity, a constant thrust can be obtained by regulating the pressure within the rocket motor by suitable nozzle design to maintain it within the mesa region.

U.S. Pat. No. 3,138,499 discloses nitrocellulose-nitroglycerine double base propellants of the mesa type containing ballistic modifiers comprising lead and/or copper salts of certain aromatic acids, particularly a mixture of lead beta resorcylate and cupric salicylate. Such propellants are characterized, inter alia, by substantially constant burning rates regardless of initial temperature between the pressure ranges of about 200 to over 4000 psi absolute. According to the patent the propellants are made via a "solventless process" by adding the finely ground ballistic modifiers and conventional stabilizers and plasticizers to an agitated aqueous slurry of nitrocellulose and nitroglycerine until a homogeneous mixture is obtained, centrifuging the mass to remove most of the water, aging the resulting paste for 1–5 days at 130° F and thereafter milling the resulting mass to a homogeneous colloid on a heated differential rolling mill.

It has been recently found that instead of incorporating the aforesaid ballistic modifiers into the aqueous slurry of the double base propellant as described in the patent, it is advantageous to heat a mixture of the ballistic modifiers with water or an alcohol independently to produce a reaction product prior to incorporation thereof into the propellant composition, as described in copending U.S. patent application entitled "Ballistic Modifier", Thomas Dunigan et al inventors, Ser. No. 78,954 filed Oct. 7, 1970. The process provides better control over quality and performance of the ballistic modifier and permits incorporation thereof into the propellant composition by the organic solvent method, which provides important processing advantages over the aqueous slurry method described in the patent.

Unfortunately, the aforesaid propellant composition produced according to the patent, on standing for several months at ordinary temperatures, develops a white crystalline growth on the surface thereof, which acts as an ignition inhibitor. This in turn produces ignition failures, which represent a serious problem with such propellant compositions. The crystalline exudate has been found to consist essentially of beta resorcylic acid, which appears to be the effective ignition inhibitor and is apparently formed by hydrolysis of the lead salt.

By independently preparing a reaction product from lead resorcylate, cupric salicylate and water and incorporating it into the propellant composition by the organic solvent method, as described in the aforesaid patent application, the exudate problem is minimized. However, the problem is still serious when the ratio of the lead salt to copper salt used in said reaction product is greater than unity, which is the more urgent since such ratios include the most effective and desirable ballistic modifier products.

DESCRIPTION OF THE INVENTION

A principal object of this invention is to provide a novel ballistic modifier from lead beta resorcylate and especially mixtures thereof with cupric salicylate, characterized by improved resistance to hydrolysis, and process therefor.

Another object is to provide nitrocellulose-nitroglycerine double base propellant compositions containing such a novel ballistic modifier, which possess superior resistance to exudate formation on storage and excellent ballistic properties.

A further object is to provide a nitrocellulose-nitroglycerine double base propellant composition of the mesa type.

A still further object is to provide a nitrocellulose-nitroglycerine double base propellant of the mesa type characterized by high burning rate combined with high mesa value.

Other objects will be obvious or will appear from the description of the invention.

These objects are achieved according to the present invention by a novel ballistic modifier obtained as a complex product by interaction of an organic isocyanate, e.g. toluene diisocyanate, and lead beta resorcylate, preferably in combination with cupric salicylate. The novel ballistic modifier complex is surprisingly resistant to hydrolysis. When incorporated into a nitrocellulose-nitroglycerine double base propellant containing conventional plasticizers and stabilizers, it yields a propellant composition, which possesses improved storage stability, i.e. resistance to formation of aforesaid ignition-inhibiting exudate, and excellent ballistic properties.

The novel ballistic modifier complex is preferably produced by mixing the organic isocyanate and lead beta resorcylate with or without the cupric salicylate, in the presence of an inert liquid solvent or diluent in sufficient amount to provide a stirrable mixture, agitating the mixture at ordinary or elevated temperatures, and thereafter removing the solvent or diluent by evaporation. The components may be mixed together in any desired sequence or manner. The solid residue thus obtained is ground to a fine powder and mixed with the propellant. Apparently a chemical reaction takes place between the isocyanate and the metal salts, since differential thermal analysis of the aforesaid residue, hereinafter referred to as the ballistic modifier complex, shows the presence of a novel compound of unknown constitution.

A small amount of organic isocyanate is effective for imparting exudate growth-inhibiting properties to the ballistic modifier. Preferably, a ratio of about from 1 to about 10% of organic isocyanate, based on the total weight of the lead and copper salts, is employed. Larger ratios of organic isocyanate, e.g. up to about 20%, can be effectively employed, if desired, but are generally no more effective and are hence uneconomical, while smaller proportions of organic isocyanate are less effective.

In place of toluene diisocyanate other organic mono- and polyisocyanates can be employed in similar manner with analogous results. Suitable organic isocyanates include benzene-1,4-diisocyanate, toluene-2,4- and 2,6-diisocyanates, diphenylmethane-4,4′-diisocyanate, naphthalene-1,5-diisocyanate, polymethylene-polyphenyl polyisocyanates obtained by phosgenation of polyamines such as are produced by condensation of formaldehyde and aniline, hexane-1,6-diisocyanate, dicyclohexylmethane-4,4′-diisocyanate, phenylisocyanate, prepolymers containing 2, 3 or more free isocyanate groups per molecule, such as can be obtained by reacting toluene-2,4-diisocyanate with an organic polyol e.g. ethylene glycol, glycerine, polyethylene ether glycols, etc.

Both the monobasic and dibasic (normal) salts of lead beta resorcylate and cupric salicylate can be employed. The relative weight ratios of these salts can be varied widely, e.g. from about 5 parts by weight of lead resorcylate per 95 parts cupric salicylate to about 0 parts cupric salicylate per 100 parts lead resorcylate. Ballistic modifier complexes of particularly desirable properties are obtained by employing mixtures of these salts containing about 50 to 85 parts lead beta resorcylate and about 15 to 50 parts of cupric salicylate.

In place of heptane other inert organic solvents or diluents can be employed, e.g. hexane, benzene, toluene, acetone and ethylacetate.

The reaction of the organic isocyanate with the lead and copper salts and removal of the solvent or diluent can be carried out at ordinary or moderately elevated temperatures. If excessive temperatures are employed a brownish or dark colored residue rather than a light or greenish colored product is obtained, which exhibits inferior ballistic modification properties and relatively little or no ability to prevent said exudate formation.

The preferred amount of novel ballistic modifier complex employed ranges from about 1 to about 10% by weight of the double base propellant composition, which generally consists of about 40–65% nitrocellulose, 20–45% nitroglycerine, 1–10% plasticizer and 1–5% stabilizer. Suitable plasticizers are well known and include dibutylphthalate, dipropyl adipate, dibutytindilaurate and dihexylsuccinate. Suitable stabilizers are also well known and include 2-nitrodiphenylamine, diphenylamine, ethyl centralite and n-methyl-p-nitroaniline.

The novel ballistic modifier complex is advantageously incorporated into the propellant composition by the so called solvent/solventless process, described in aforesaid copending U.S. patent application, wherein the components are mixed or kneaded in the presence of an excess of organic solvent e.g. acetone, alcohol, etc., until a gelatinous, colloidized mass is obtained, after which the solvent is evaporated and the resulting "solventless" product containing about 5–15% residual solvent is pressed through a die into strands.

The invention is illustrated by the following examples, in which the parts are by weight and the temperatures are in degrees Fahrenheit.

EXAMPLES 1–19

A series of ballistic modifier products was prepared from the following mixtures:

| Component | | | | | | | | | | | | | | | | | | |
|---|---|---|---|---|---|---|---|---|---|---|---|---|---|---|---|---|---|---|
| normal lead beta resorcylate (NLBR) (National Lead Co., Hightstown, N. J.) | | | | | | | | | | | | | | | | | | |
| Ex.1 | 2 | 3 | 4 | 5 | 6 | 7 | 8 | 9 | 10 | 11 | 12 | 13 | 14 | 15 | 16 | 17 | 18 | 19 |
| 90 | 85 | 80 | 75 | 70 | 65 | 60 | 55 | 50 | 45 | 40 | 35 | 30 | 25 | 20 | 15 | 10 | 5 | 50 |
| monobasic cupric salicylate (MBCS) (National Lead Co., Hightstown, N. J.) | | | | | | | | | | | | | | | | | | |
| 5 | 10 | 15 | 20 | 25 | 30 | 35 | 40 | 45 | 50 | 55 | 60 | 65 | 70 | 75 | 80 | 85 | 90 | 50 |
| toluene diisocyanate* (TDI) | | | | | | | | | | | | | | | | | | |
| 5 | 5 | 5 | 5 | 5 | 5 | 5 | 5 | 5 | 5 | 5 | 5 | 5 | 5 | 5 | 5 | 5 | 5 | 5** |

*an 80/20 mixture of the 24- and 26- isomers.
**added to 50–50 mixture.

The NLBR and MBCS, both in powder form, and TDI liquid were added in that order to about an equal weight of n-heptane in a glass beaker with agitation. The slurry thus obtained was continuously agitated at room temperature while passing a current of air over its surface until the heptane was evaporated. The greenish colored solid thus obtained was ground to a fine powder and passed through a U.S. No. 325 screen.

Differential thermal analysis of the products thus obtained revealed the presence of a new compound of unknown composition formed apparently by a chemical reaction.

The ballistic modifier products prepared in the foregoing manner were incorporated into a standard nitrocellulose-nitroglycerine propellant as described in the following example:

EXAMPLE 20.

Propellant compositions of the following formulation were prepared in the manner described below. The percentages are by weight.

| | |
|---|---|
| nitrocellulose (dry, 12.6% N) | 49.1% |
| nitroglycerine | 40.6% |
| di-n-propyl adipate | 3.3% |
| 2-nitrodiphenylamine | 2.0% |
| ballistic modifiers from Examples 1–19 | 5.0% |

The nitrocellulose (water-wet, containing 10% water), 2-nitrodiphenylamine and ballistic modifier were blended in a sigma blade mixer at room temperature for about 30 minutes. The di-n-propyl adipate and nitroglycerine were charged in the named order followed by an excess of acetone solvent to aid colloidization. At this point the mass contained about 100% solvent consisting of approximately 95% acetone and 5% water, based on the weight of the above formulation. Mixing was continued until a gelatinous mass, often lumpy, resulted (usually about 1 hour). Thereafter, a current of air was passed over the mixer contents to evaporate the solvent while continuing the mixing at room temperature, during which, as the solvent was evaporated, the mass gradually became tough and doughy and finally crumbled into marble-size pieces. These were pressed through a series of screens of increasing fineness (No. 12, 24 and finally 36 mesh) and extruded through a die of 0.117 in. diameter. The resulting strands were cut into 0.120 in. lengths. The pieces thus obtained were dried first at room temperature for 7 days and then at 115° F for 10 days in an atmospheric oven. The dried pieces were finally extruded through a die of 0.125 in. diameter into strands, which were cut into 7.25 in. lengths.

No exudate (white crystalline growth) was observed on the surface of any of the propellant strands thus obtained after exposure to the atmosphere at temperatures ranging from about 65° to 95° F for a period of 4 months.

The propellant strands were submitted to burning rate tests in a Crawford type Strand Burning Rate Apparatus, and logarithmic graphs showing the relationship of burning rate to pressure were developed in usual manner from the data obtained.

The graphs revealed that all of the propellants possessed high burning rates and mesa or plateau type characteristics. Mesa burning characteristics were obtained with the propellants produced with the novel ballistic modifier complexes of examples 5 to 15 and 19, wherein the maximum burning rates ranged from 1.124 to 1.299 in./sec. in the 2000 to 2600 psi pressure range at 70° F. Plateau characteristics in the 1000 to 3800 psi pressure range at 70° F with burning rates from about 0.7 to about 1.2 in./sec. were obtained with the propellants produced from the novel ballistic modifier complexes of examples 1 to 4 and 16 to 18.

FIG. 1 shows the graph for the propellant of example 20 produced from the ballistic modifier product of example 7. It exhibits a maximum burning rate of 1.299 in./sec. at 2600 psi at 70° F. and mesa burning characteristics in the 3000–3800 psi region with a negative slope of 0.51. This high burning rate combined with high negative slope is valuable and unexpected.

In comparison with propellant strands obtained above, corresponding propellant strands obtained by incorporating 1. mechanical mixtures of NLBR and MBCS exhibited pronounced exudate on standing at ambient temperatures for 3 months and possessed inferior ballistic properties;
2. complexes obtained according to the aforementioned U.S. patent application by interaction of water with mixtures of NLBR and MBCS containing a greater weight ratio of the former to the latter salt, exhibited pronounced exudate on standing at ordinary temperatures for 3 months and possessed inferior ballistic properties.

We wish it to be understood that we do not desire to be limited to the exact detail of construction shown and described for obvious modification will occur to a person skilled in the art.

What is claimed is:

1. A ballistic modifier complex resistant to hydrolysis comprising the product obtained by reacting a minor amount of an organic isocyanate with a material selected from the group consisting of lead beta resorcylate and a mixture of lead beta resorcylate and cupric salicylate in an inert solvent or diluent at ordinary to moderately elevated temperatures and thereafter removing said solvent or diluent.

2. The ballistic modifier of claim 1, wherein the material is a mixture consisting essentially of about 5 to 95% lead beta resorcylate and about 95 to 5% cupric salicylate, and the organic isocyanate is an organic polyisocyanate in amount of about 1 to 10% by weight of said mixture.

3. The ballistic modifier of claim 2, wherein the lead beta resorcylate is normal lead beta resorcylate and the cupric salicylate is monobasic cupric salicylate.

4. The ballistic modifier of claim 3, wherein the organic polyisocyanate is toluene diisocyanate.

5. The ballistic modifier of claim 2, wherein the mixture consists essentially of about 50 to 85% lead beta resorcylate and about 15 to 50% cupric salicylate.

6. The ballistic modifier of claim 5, wherein the lead beta resorcylate is normal lead beta resorcylate and the cupric salicylate is monobasic cupric salicylate, and the organic polyisocyanate is toluene diisocyanate in amount of 5% by weight of said mixture.

* * * * *